United States Patent [19]

Clement

[11] Patent Number: 4,729,272

[45] **Date of Patent: * Mar. 8, 1988**

[54] WIRE ROPE SALVAGING APPARATUS

[76] Inventor: Kenward J. Clement, 1230 Fig St., Morgan City, La. 70380

[ * ] Notice: The portion of the term of this patent subsequent to Jul. 14, 2004 has been disclaimed.

[21] Appl. No.: 864,715

[22] Filed: May 19, 1986

Related U.S. Application Data

[63] Continuation-in-part of Ser. No. 559,400, Dec. 8, 1983, Pat. No. 4,589,315.

[51] Int. Cl.[4] ..... B26D 5/20

[52] U.S. Cl. ..... 83/202; 83/422; 83/423; 83/436; 83/694; 83/923; 226/115

[58] Field of Search ..... 83/202, 208–212, 83/241, 423, 580, 694, 923, 924; 226/120

[56] References Cited

U.S. PATENT DOCUMENTS

| | | | |
|---|---|---|---|
| 3,161,215 | 12/1964 | Werder et al. | 83/276 X |
| 3,251,253 | 5/1966 | Eubanks | 83/422 X |
| 3,301,114 | 1/1967 | Joa | 83/276 X |
| 3,491,637 | 1/1970 | Hasten et al. | 83/422 X |
| 4,398,439 | 8/1983 | Bryan et al. | 83/422 X |
| 4,589,315 | 5/1986 | Clement | 83/202 X |

*Primary Examiner*—Frank T. Yost

*Attorney, Agent, or Firm*—Pravel, Gambrell, Hewitt, Kimball & Krieger

[57] ABSTRACT

A wire rope salvaging apparatus provides a frame which supports an intermittent feed mechanism which moves wire rope to be cut a small length at a time as defined by the stroke of the feed mechanism. A blade also mounted on the frame cuts the wire rope at preselected interval lengths, the blade being movable between cutting and feeding positions. A timing mechanism coordinates movement of the feed and blade mechanism so that the blade first assumes a non-cutting position during the feeding when the wire is moving and then cuts the rope when the feed has stopped and the wire rope is at a still position.

8 Claims, 18 Drawing Figures

WIRE ROPE SALVAGING APPARATUS

REFERENCE TO RELATED APPLICATION

This is a continuation-in-part application of U.S. Ser. No. 559,400 filed Dec. 8, 1983, and entitled "Wire Rope Salvaging Apparatus" which issues as U.S. Pat. No. 4,589,315 on May 20, 1986.

BACKGROUND OF THE INVENTION

The present invention relates to the salvaging of wire rope, and more particularly relates to an automatic feed and cutting mechanism for salvaging wire rope by intermittently feeding the wire rope to be salvaged to a cutting blade a preselected length at a time as defined by the stroke of the feeding mechanism.

Wire rope is well-known in the construction industry as the cable which is used for rigging cranes, draglines, dredges, and many other powered mechanisms for the lifting and moving of loads and/or materials. Probably the most common use of wire rope is on a crane or dragline where the rope itself is the elongated load carrier which is wound upon a powered winch, threaded across one or more pulleys upon a structural boom, and then lowered for connection to an object to be lifted. Wire rope is flexible, can be manufactured in virtually unlimited length, and it is quite strong though only of a small diameter of, for example, one-half to two inches.

Because of wire ropes desirable load carrying, flexible properties as aforedescribed, it is also very difficult to dispose of once it has become useless. Wire rope can become rusted, kinked, frayed, or simply cut during its normal use. Thus, large lengths of wire rope must be disposed of. A very long length of several hundred feet, for example, of wire rope which has become rusted and frayed can be very awkward to deal with. Disposal of such a length of wire rope is typically achieved by collapsing the wire rope into a small a package as possible, and then burying the rope for disposal. Manual cutting of the rope into pieces has also been done to dispose of rope.

Several devices have been patented which relate to cable cutting and shearing.

U.S. Pat. No. 4,313,356 entitled "Method of Removing Front and Rear Segments of Wire Rod" issued Feb. 2, 1982 teaches a method of removing the front and rear segments of a rolled wire fed in winding packages subdivided into good stock and into scrap windings separated by cutting movements corresponding substantially to the transporting movement of the winding packages. The windings spirally or helically surround a guidepipe element. Several cutting wheels rotate in the region of the upper surface of the guide-pipe element. The cutting wheels, together with counter knives, which stand still during the cutting procedure, form a separating device. The peripheral speed of the cutting wheel and cutters corresponds at lest substantially to the transporting speed of the winding packages.

U.S. Pat. No. 4,188,845 issued to Stukenberg and entitled "Strip Cutter" in February of 1980 discloses strips cut by an edge trimmer which are engaged by rollers pulling the strips through a pipe and permitting the strips to hang down and descent through a funnel towards a horizontally operating cutter comprised of an annular blade across which passes an excentrically rotating blade, to cut the strips into small pieces. The rotating portion of the cutter may include two blades, and the stationary part may have plural annular blades arranged around the axis of the rotation of the blades; different strips such as from different trimmers are fed to the annular blades, surrounded by separate funnels.

U.S. Pat. No. 4,205,419 issued to Aoshima in June of 1980 discloses an apparatus for cutting a tying band of a coiled material comprising a cutter for cutting the tying band, and pinch rollers for pinching and transferring the tying band after it is cut out. The cut comprises a lower cutter and a pair of upper cutters pivotally mounted on the lower cutter. The lower cutter is connected to a hydraulic cylinder and adapted to be moved up and down along a guide which is obliquely mounted to a base member by the actuation of the hydraulic cylinder. The tying band is being cut out between the lower cutter and the upper cutters.

U.S. Pat. No. 3,799,020 entitld "Scrap Chopper" issued to Hoeimer on Mar. 26, 1974. The patent teaches a rotary scrap chopper for cutting scrap edge trimming from flat sheet metal strips. The chopper comprises a pair of knife carrying rotary arbors cooperable with a stationary knife to effect cutting of the edge trimmings into short pieces of scrap metal. The arbor knives are generally rectangular in cross section and have four cutting edges located on two cylindrical faces generated about a surface of revolution, the axis of which crosses the longitudinal axis of the knife. To facilitate a progressive cut, the knives are angulated relative to the axis of the arbor and the stationary knife. They are also supported on nonradial seats of the arbor so as to provide scrap clearance immediately behind the cutting edge. The stationary knife has a cutting edge defined by two surfaces which intersect at an included angle of approximately 105°.

U.S. Pat. No. 3,727,497 issued to Davis et al on Apr. 17, 1973 teaches an apparatus for cutting an outer layer of helical wires from a cable core comprises an annular shear blade through which the core is advanced and planetary circular shear blades that cut the wires as they pass over the annular blade.

U.S. Pat. No. 3,736,822 issued to McVaugh on June 5, 1973 discloses an apparatus and method is provided for salvaging underground and overhead electrical cable. The apparatus of this invention includes a mobile platform such as a truck on which there is mounted an adjustable cable guide which guides the cable to a cable puller which draws the cable from either an underground conduit or from overhead installation. The cable is then fed to a cable cutter which is synchronized with the rate of feed of the cable so as to cut the cable into predetermined lengths. The cut lengths of the cable are then fed to a trunk or the like and hauled away to a smelter for recovery of the metal.

U.S. Pat. No. 3,612,412 entitled "Process and Apparatus for Recovering Metals from Cables" issued Oct. 12, 1971 discloses cable comprising aluminum strands wound about a steel core which is reduced to its separate metal components by cutting substantially through the aluminum strands at closely spaced intervals, but leaving the steel core intact. This frees small aluminum strand segments from the core and these segments may be reduced still further in a reduction mill. The core is wound into a roll after the segments are cut away from it. The aluminum strands are severed into the segments by blades having notches therein which are sized to fit around the core but not around the strands about the core. The blades may be mounted on revolving wheels or they may reciprocate.

U.S. Pat. No. 3,605,541 entitled "Rotary Shear and Scrap Preparation Method" patented Sept. 20, 1971 teaches high capacity shearing to prescribed lengths of various materials from rigid rods to pliable wire which is provided by a rotary drum shear, eccentrically weighted, with a cutting blade peripherally mounted so as to utilize the eccentric weighting to increase the force available for heavy-duty scrap cutting usage. Elongated scrap material to be cut to length is fed radially inwardly toward the axis of rotation of the drum between a fixed blade adn the drum mounted blade. With this system cutting force is uniform across the full length of the cutting blades.

SUMMARY OF THE PRESENT INVENTION

The present invention provides a wire rope salvaging apparatus which quickly, efficiently and at relatively low cost can cut wire rope into a number of small lengths so that it can be easily salvaged by sale, for example, as scrap.

The apparatus includes a frame which carries an intermittent feed mechanism for moving the wire rope to be cut a small preselected length at a time. The length of rope to be cut is defined by the stroke of the feed mechanism. A blade mounted also upon the frame cuts the wire rope at preselected interval lengths and in synchrony with the intermittent feed means. The blade assumes a first non-cutting position when the feed mechanism is moving the wire rope with respect to the frame and the blade assumes a cutting position when the feed mechanism has stopped and the wire rope is at the end of the stroke.

The feed mechanism can comprise a pair of opposed endless chains driving wheels which frictionally engage the rope and are mounted radially with respect to each other about the wire rope being fed. Each chain has a section which is positioned adjacent the rope being fed and a plurality of gripping teeth are carried at intervals on the chains for pulling the chain to rotate drive wheels which engage the rope.

Each of the endless chains preferably drives a pair of wheels which are rotatably affixed to the frame. The endless chains are wound about sprockets sharing a common shaft with the drive wheels.

The blade assembly includes a first and second blade element which are movable with respect to one another. The cutting edges of the blades are beveled so that when the two blades cut the wire rope, they are forced in close face-to-face alignment. This produces a shear of the rope when the two blades meet.

A timing mechanism can include hand-operable hydraulic valves which selectively actuate either the feed mechanism or the blade mechanism.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF A PREFERRED EMBODIMENT

Figure 1:
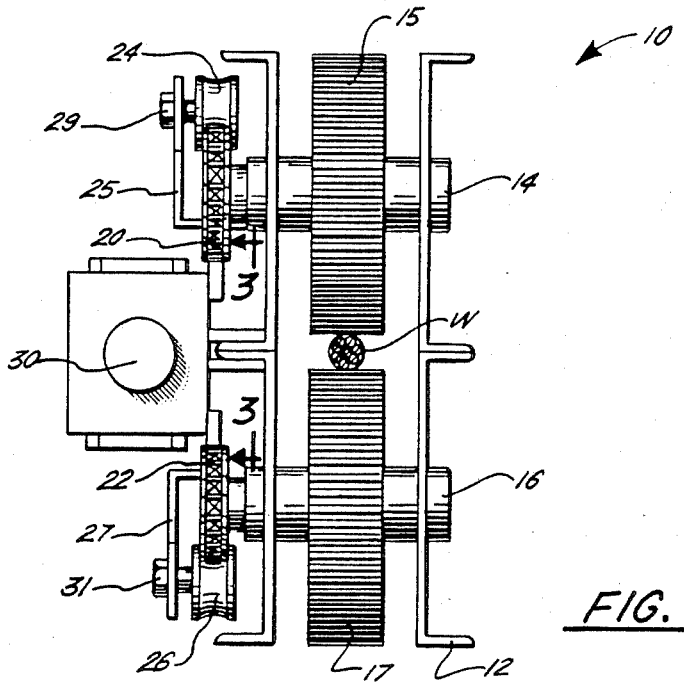
FIG. 1 is a partial end view of the preferred embodiment of the apparatus of the present invention illustrating the feed mechanism portion thereof.
Figure 2:
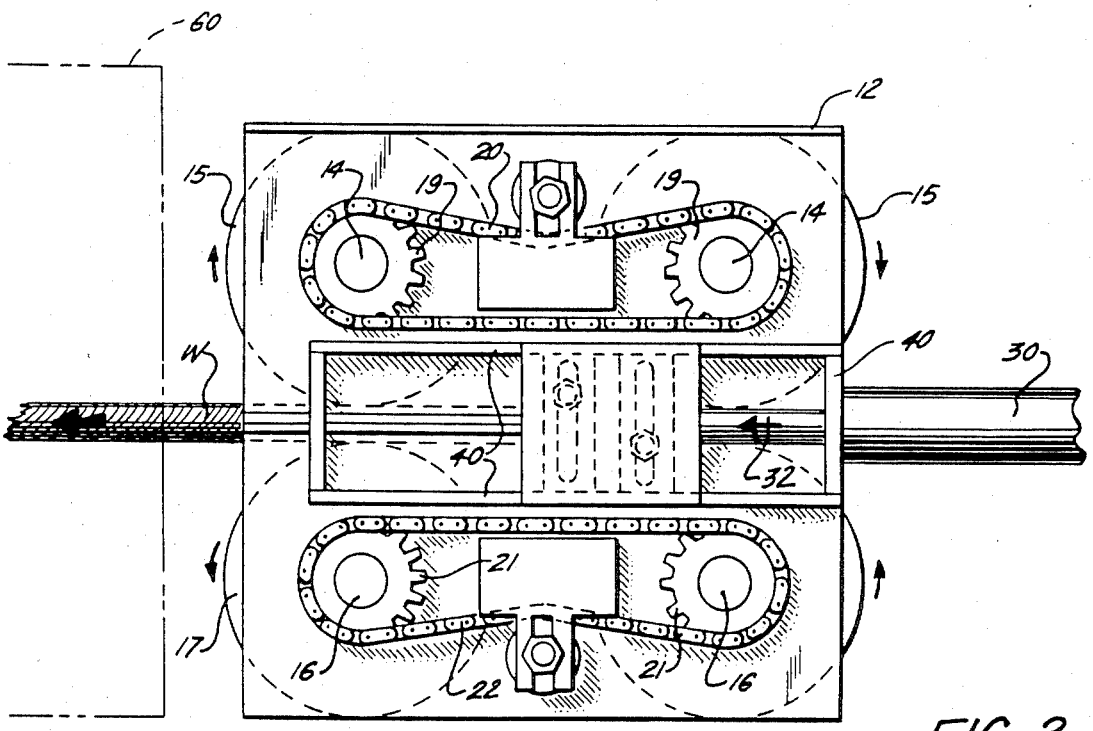
FIG. 2 is a partial side view of the feed mechansim of FIG. 1.

FIGS. 1–2 illustrate generally the preferred embodiment of the apparatus of the present invention designated generally by the numeral 10.

In FIG. 1 there can be seen a supportive frame 12 which carries pairs of upper and lower shafts 14, 16. Each shaft 14, 16 supports a notched wheel 15, 17, respectively. Each wheel 15, 17 provides transverse notches which grip and engage a section of wire rope W to be cut into relatively short lengths.

In FIG. 2, a side view reveals a pair of upper drive wheels 15, each carried by an associated shaft 14 and a pair of lowermost drive wheels 17, the combination used to drive wire rope W. Lower wheels 17 are rotatably supported upon shafts 16. Wheels 15, 17 are closely spaced as shown in FIG. 1 so that they bear against and frictionally engage wire rope W. It should be understood that frame 12 could be closely spaced to the sides of wheels 15, 17 so that wire rope would not become disengaged but would be laterally confined by wheels 15, 17. Such lateral guides of frame 12 are not shown in FIG. 1 for purposes of clarity.

Each shaft 14, 16 is driven by an associated sprocket 19, 21. Sprockets 19, 21 are engaged by endless chains 20, 22. Idler pulleys 24, 26 can regulate the tension of chains 20, 22. Each idler pulley 24, 26 is adjustably supported upon brackets 25, 27 by removable bolted connections 29, 31.

Figure 3:
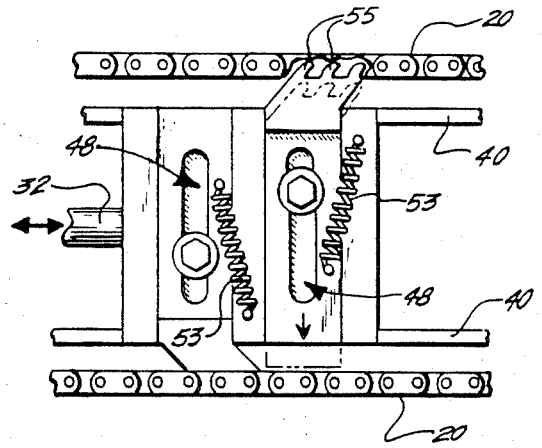
FIG. 3 is a fragmentary view of the feed mechanism of FIGS. 1 and 2 illustrating the gripping teeth portions thereof.
Figure 4:
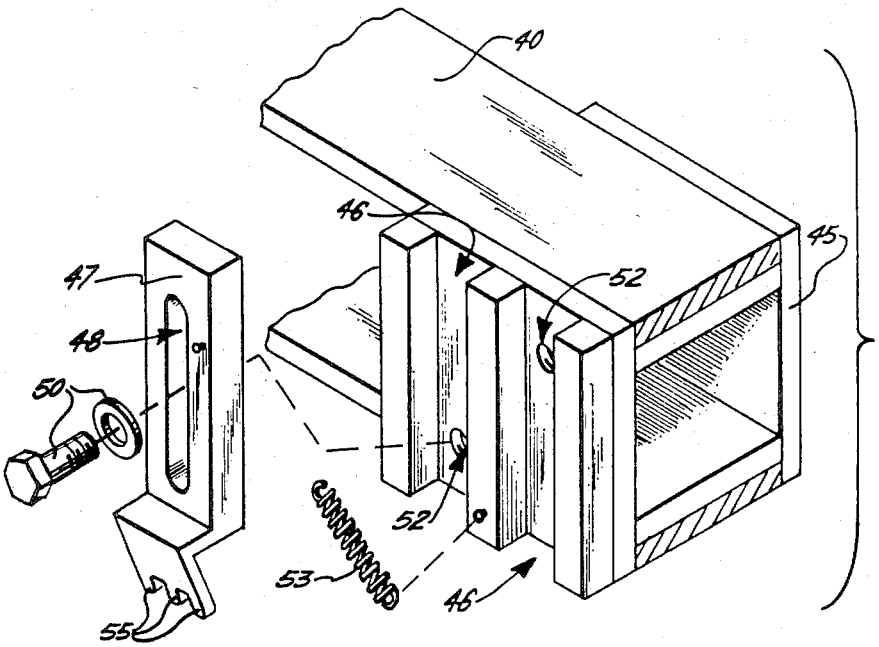
FIG. 4 is a fragmentary, perspective view of the preferred embodiment of the apparatus of the present invention illustrating one of the chain gripping teeth portions thereof.

Chains 20, 22 are driven by hydraulic cylinder 30 and its associated pushrod 32 which forcibly move a carrier 45 and its associated chain drivers 47 along runway 40. FIGS. 2–4 more clearly show pushrod 32, and its attachment to runway 40 which forms a portion of frame 12. Runway 40 supports in a slidable fashion, carrier 45. Each carrier 45 slidably supports a pair of chain drivers 47 which are mounted upon carrier 45 and which can slide in a vertical direction in the slotted 46 portions thereof. Chain drivers 47 are secured in a desired position in slots 46 by bolting using, for example, a bolt and washer assembly 50. Slotted opening 48 allows chain drivers 47 to slide in vertical directions. Bolted assembly 50 affixes to threaded opening 52 of each carrier 45. Springs 53 urge chain driver 47 into engagement with the chain 20 as shown in phantom (disengaged) and in hard lines (engaged) in FIG. 3. Teeth 55 on each chain driver engage with each chain 20, 22. The individual teeth 55 are spaced to correspond with the chain link spacing so that one tooth engages one chain link.

By repeatedly extending and contracting pushrod 32 of cylinder 30, the wire rope W is advanced a preselected distance which equals the stroke of the pushrod 30. Since teeth 55 are forwardly slanted away from cylinder 30, the chains 20, 22 are only urged to move when the pushrod 32 is extended. When the pushrod is withdrawn, however, teeth 55 merely slide over the chains 20, 22. Hydraulic cylinder 30 could be controlled by means of hydraulic fluid and regulated by a hand-controlled valve, such as a hydraulic lever operated valve. Thus, a human operator could repeatedly extend and withdraw the hydraulic cylinder from a remote location by, for example, manipulation of a lever on such a hand-controlled valve.

Figure 5:
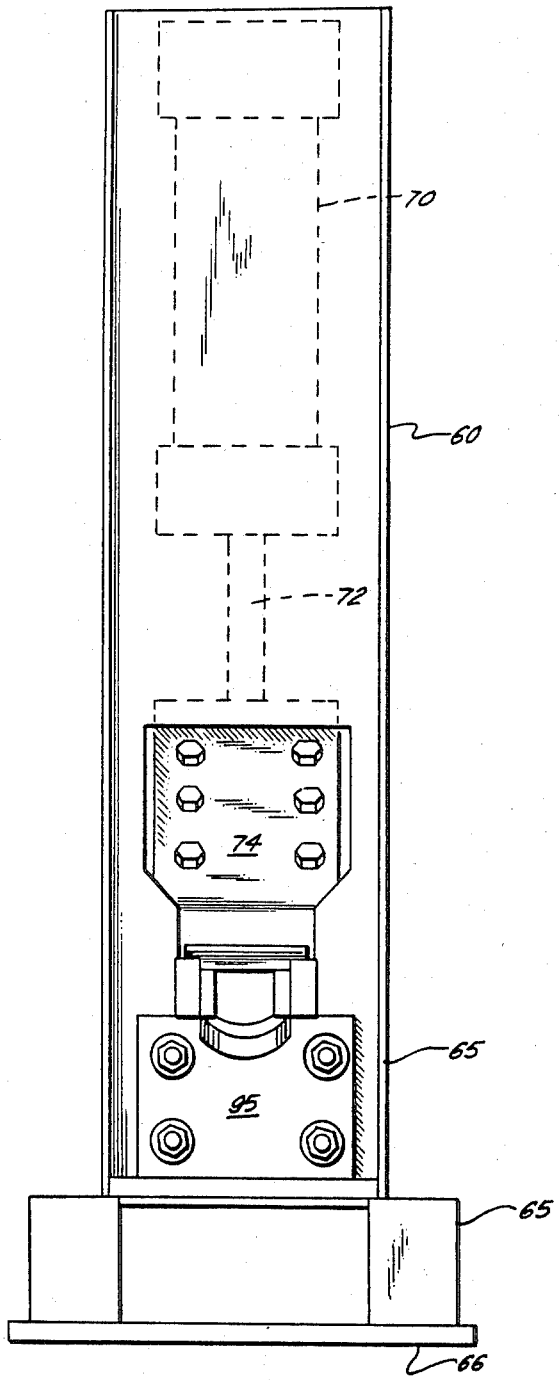
FIG. 5 is a front view of the cutting blade portion of the preferred embodiment of the apparatus of the present invention shown in the closed or cutting position.
Figure 6:
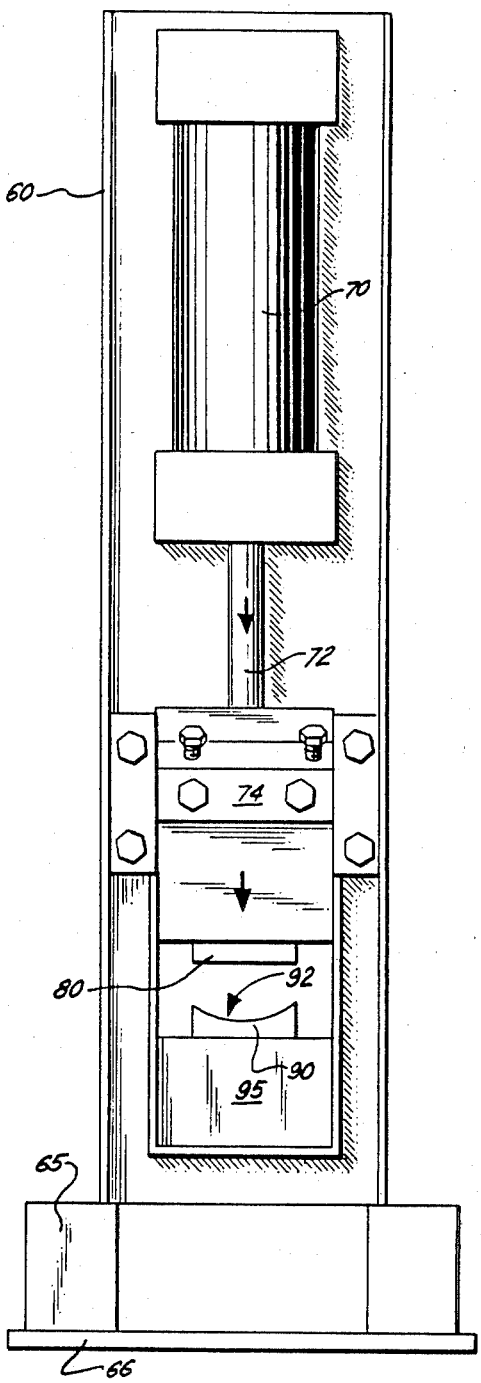
FIG. 6 is a front view of the preferred embodiment of the apparatus of the present invention illustrating the cutting blade in a feed position and prior to cutting.
Figure 7:
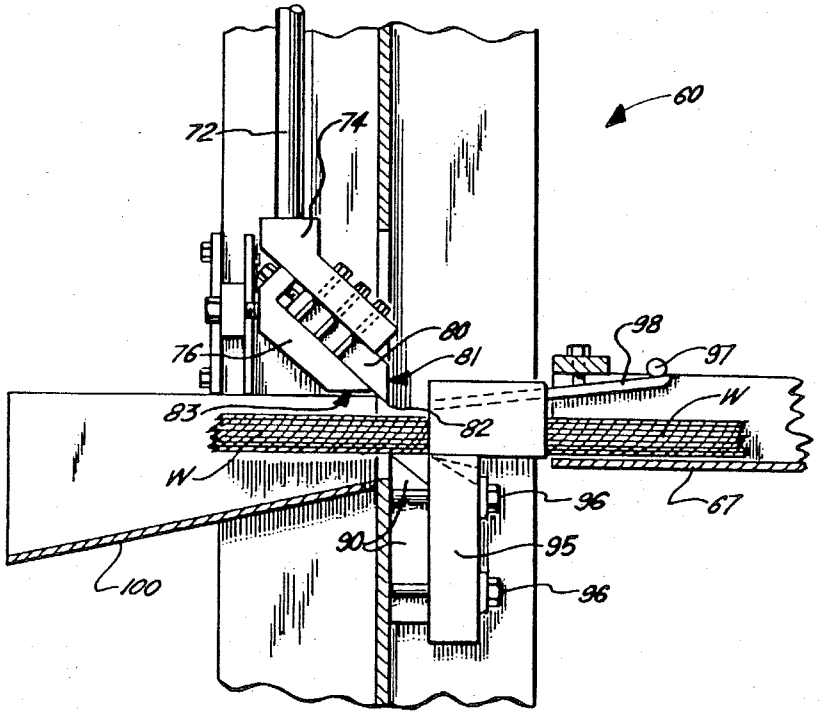
FIG. 7 is a partial, sectional view of the cutting blade assembly portion of the preferred embodiment of the apparatus of the present invention prior to cutting.
Figure 9:
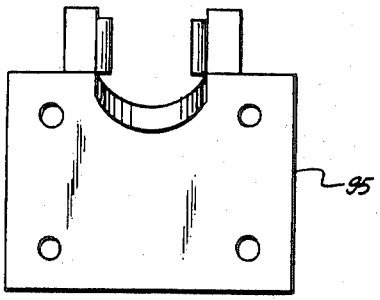
FIG. 9 is a perspective, front view of the blade carrier portion of the preferred embodiment of the apparatus of the present invention.
Figure 11:
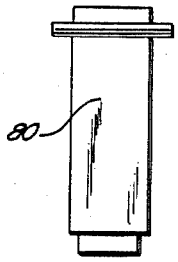
FIGS. 11–13 are top, bottom, and end views of the upper, removable portion of the rope guide of the preferred embodiment of the apparatus of the present invention.
Figure 12:
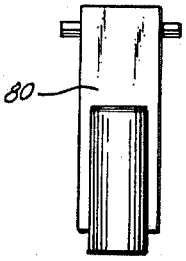
Figure 10:
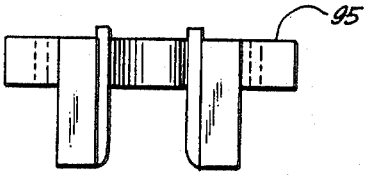
FIG. 10 is a front view of one of the blade support portions of the cutting blade assembly.
Figure 13:
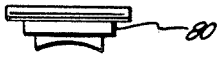
Figure 14:
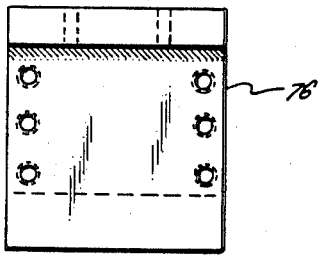
FIG. 14 is a front view of the blade carrier of the preferred embodiment of the apparatus of the present invention.
Figure 15:
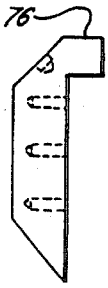
FIG. 15 is a side view of the blade carrier of the preferred embodiment of the apparatus of the present invention.
Figure 16:
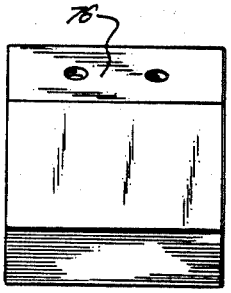
FIG. 16 is a rear view of the blade carrier of the preferred embodiment of the apparatus of the present invention.

In FIG. 1 the numeral 60 schematically illustrates the cutting assembly as shown in FIGS. 5–7.

Figure 8:
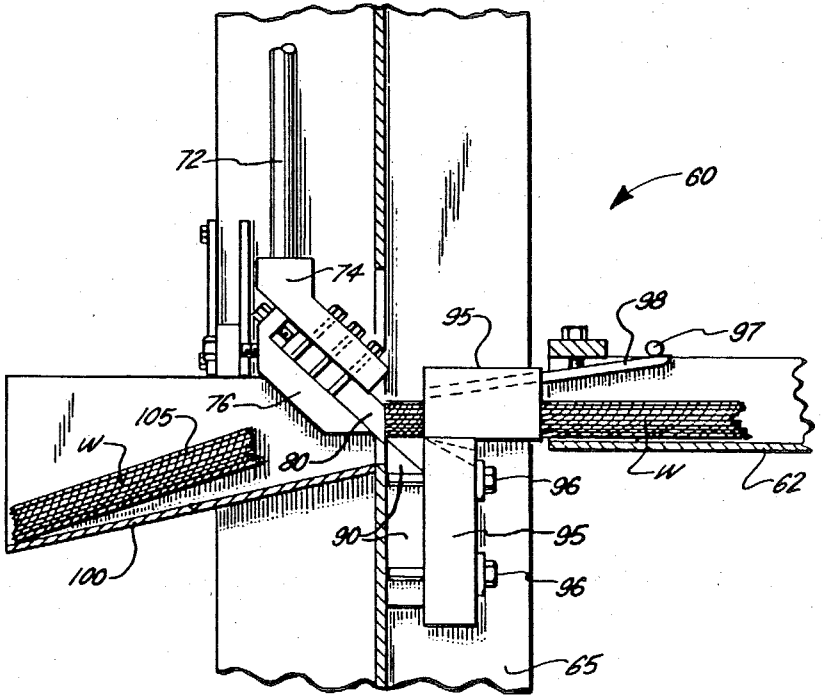
FIG. 8 is another side view of the cutting blade assembly portion of the preferred embodiment of the apparatus of the present invention shown during cutting.

FIGS. 7–8 show a rope guide 62 which would be preferably a section of structural tubing such as square or round tubing. Rope guide 62 would be bolted between the feed mechanism frame 12 of FIG. 2 and the cutting mechanism frame 65 of FIGS. 5–8. Cutting mechansim 60 provides a supportive frame 65 having a base 66. Frame 65 supports a hydraulic cylinder 70 with a pushrod 72 which is extendable. Frames 12, 65 could be bolted to a common support such as a concrete slab with anchor bolts so that rigidity, structural integrity and alignment are insured.

The lowermost end portion of the pushrod 72 supports an upper blade carrier 74 and a lower blade carrier 76 which is bolted to the upper blade carrier 74. A movable cutting blade 80 is sandwiched between blade carriers 74, 76 and held in place by bolting (see FIGS. 7–8). Blade 80 has a cutting edge 82 defined by intersecting flat surfaces 81 and 83 of blade 80. A lowermost, normally static cutting blade 90 is supported by static blade carrier 95. Static blade 90 has a cutting edge 92 formed by intersecting surfaces 93, 94. Blade 90 can be welded, for example, to carrier 95. Carrier 95 is preferably bolted to frame 65 so that it can be removed for replacement. Bolts 96 in FIGS. 7–8 secure carrier 95 to frame 65. Blade 90 has a concave cutting edge 92 (see FIG. 6) which helps center rope W during cutting. Swing gate 98 is a weighted gate which is pivotally supported to cable guide 62 at shaft 97. Shaft 97 has a width greater than the width of guide 62 while swing gate 98 has a width smaller than guide 62 so that gate 98 can freely move within guide 62. Gate 98 urges wire cable W against static blade 90. The underside 99 of gate 98 is curved and concave so that it, like blade 90 tends to "center" wire cable W during cutting.

Tray 100 catches individual cut sections 105 of wire rope which has been cut.

Figure 17:
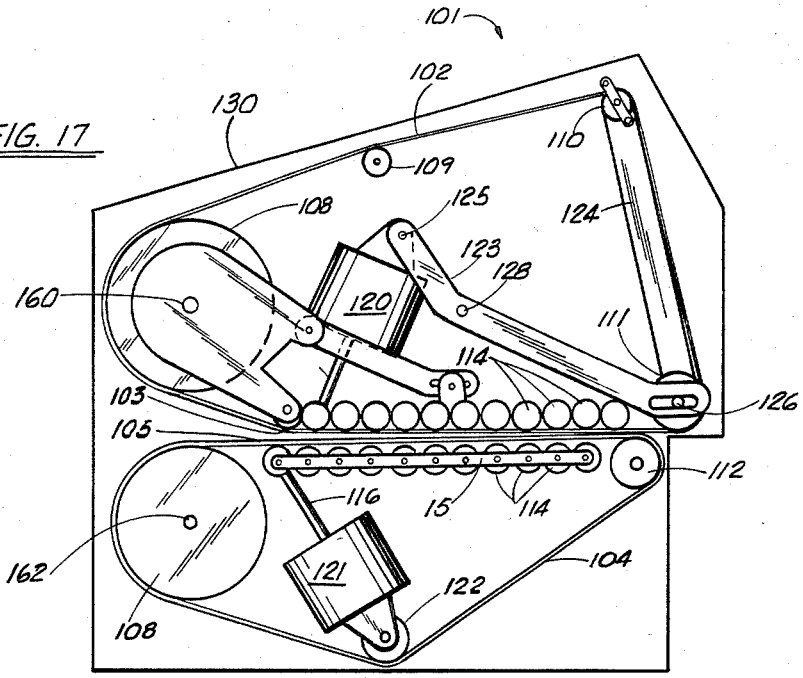
FIG. 17 is a partial side view of an alternate embodiment of the apparatus of the present invention.
Figure 18:
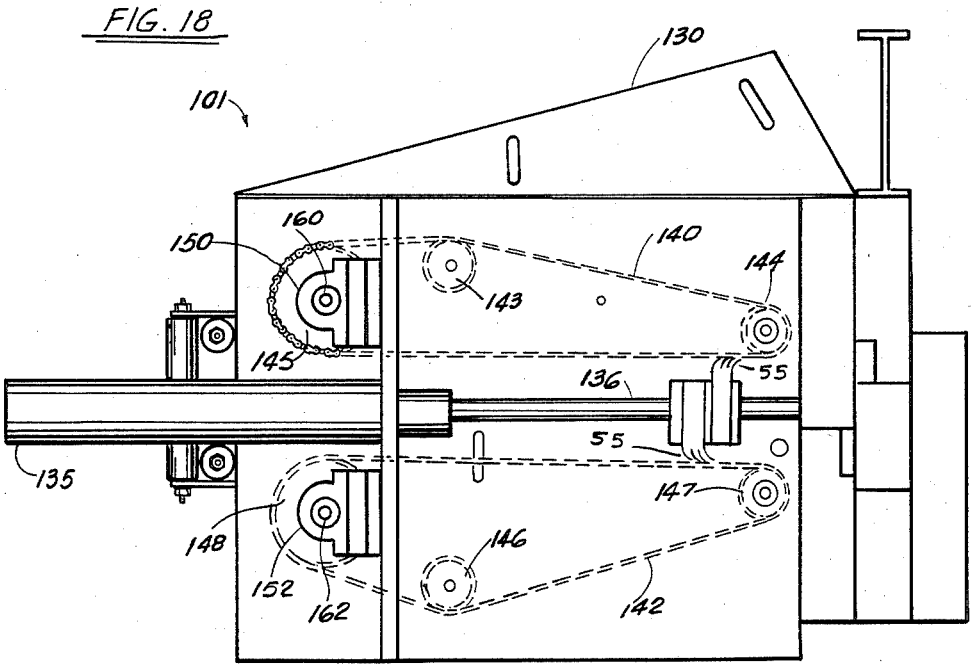
FIG. 18 is a partial side view of another alternate embodiment of the apparatus of the present invention.

FIGS. 17 and 18 illustrate an alternate embodiment of the apparatus of the present invention designated generally by the numeral 101. In the embodiment of FIGS. 17 and 18, a pair of continuous belts 102, 104 include portions 103, 105 which abut so that the wire cable being cut can be sandwiched therebetween in a similar fashion to the gripping of wire rope W by wheels 15, 17 as shown in FIGS. 1 and 2. Belt 102 is supported internally by a plurality of rollers including enlarged roller 108 and a plurality of small rollers 109–111. Additionally, a series of rollers 114 are mounted upon a common frame 115. Simiarly, the belt 104 includes a series of rollers 114 supported upon a common frame 115. Each frame 15 is attached at its end portion to a pushrod 116, 117 respectively of hydraulic cylinders 120, 121. The cylinder 121 carries a roller 122 which abuts the internal surface of endless belt 104. A pair of angularly intersecting links 123, 124 are provided internally of continuous belt 102. The link 123 is attached at 125 to hydraulic cylinder 120 and at its other portion forms a pivotal connection with link 124 at pin 126 which defines the center of roller 111. 128 designates a pinned connection with a housing 130 which can be, for example, a welded structural steel frame. Thus, actuation of hydraulic cylinder 120 applies tension to the frame 115 and thus regulates tension of the belt 102. Similarly, extension and retraction of the cylinder 121 and its pushrod 116 regulates tension of belt 104.

In FIG. 18, hydraulic cylinder 135 has a pushrod 136. Extension and retraction of the pushrod causes the chains 140, 142 to rotate about idler sprockets 143–145, and 146–148. 150–152 designate ratchet assemblies which only allow rotation in one direction only, thus allowing chains 140, 142 to drive the rollers 108 in one direction. A connection is formed between cylinder pushrod 136 and chains 140, 142 as shown in FIG. 3, except that teeth 55 would be welded, for example, to the chain since ratchets 150, 152 provide the one direction rotation of the wheels 108 and thus the belts 140, 142. When the ratchets engage and the cylinder and pushrod expand with respect to each other, the shafts 160, 162 are rotated, thus rotating drive wheels 108 to move the continuous belts 102, 104. Ratchets 150, 152 thus insure that wheels 108 only rotate in one direction.

Because many varying and different embodiments may be made within the scope of the inventive concept herein taught, and because many modifications may be made in the embodiments herein detailed in accordance with the descriptive requirement of the law, it is to be understood that the details herein taught are to be interpreted as illustrative and not in a limiting sense.

What is claimed as the invention is:

1. A wire rope salvaging apparatus comprising:

a. a frame;

b. a plurality of cable engaging endless belts movably mounted on the frame;

c. cylinder means mounted on the frame and including an extensible pushrod movable between retracted and extended positions; and d. drive means carries at least in part by the pushrod for moving one or more of the endless belts responsive to movement of the pushrod so that when the pushrod is moved between the extended and retracted positions, a length of wire rope is responsively advanced by the endless belts, and wherein the drive means comprises a pair of opposed endless chains and a corresponding pair of chain engaging means carried by the pushrods so that the rope is advanced responsive to movement of the chains; and e. cutting means carried by the frame for cutting the length of wire rope after it has been advanced.

2. The wire rope salvaging apparatus of claim 1, further comprising multiple chain supporting pulleys on the frame and wherein each endless chain is rotatably affixed to the frame upon a pair of pulleys.

3. The wire rope salvaging apparatus of claim 1, wherein the cutting means includes first and second blade elements movably supported on the frame with respect to one another.

4. The wire rope salvaging apparatus of claim 3, wherein each blade element has a cutting edge, and the cutting edges are positioned upon the frame on opposite sides of the wire rope in the cutting position.

5. The wire rope salvaging apparatus of claim 4 in which the cutting edge of at least one blade element is concave to aid in centering the wire rope during cutting.

6. The wire rope salvaging apparatus of claim 5 in which one blade element moves toward the other blade element which remains stationary during the cutting process.

7. The wire rope salvaging apparatus of claim 3, wherein the two blade elements slide beside one another during cutting to shear the wire rope.

8. The wire rope salvaging apparatus of claim 1 in which the chain engaging means comprise teeth which are forwardly slanted away from the cylinder means such that when the pushrod is extended, the teeth engage the endless chains and when the pushrod is retracted, the teeth slide over the endless chains.

* * * * *